United States Patent [19]

McBurnett et al.

[11] Patent Number: 4,746,276

[45] Date of Patent: May 24, 1988

[54] GEAR PUMP HAVING CONDITIONAL DRY VALVE CLOSURE STRUCTURE

[75] Inventors: James R. McBurnett; James M. Eley; Kuldip Raina, all of Corinth, Miss.

[73] Assignee: Dana Corporation, Toledo, Ohio

[21] Appl. No.: 20,007

[22] Filed: Feb. 27, 1987

[51] Int. Cl.[4] ..... F04B 49/02; F04B 49/08

[52] U.S. Cl. ..... 417/295; 417/310

[58] Field of Search ..... 417/295, 310, 440; 60/459

[56] References Cited

U.S. PATENT DOCUMENTS

| | | | |
|---|---|---|---|
| 3,280,557 | 4/1965 | Sattavara . | |
| 3,407,894 | 10/1968 | Thompson et al. . | |
| 3,424,262 | 7/1967 | Kunz . | |
| 3,434,282 | 4/1967 | Shelhart . | |
| 3,447,496 | 6/1969 | Short | 417/295 |
| 3,476,055 | 11/1969 | Crowther | 417/440 |
| 3,696,613 | 10/1972 | Goodale . | |
| 3,747,725 | 7/1973 | Feustel et al. . | |
| 3,935,917 | 2/1976 | Eley | 60/459 |
| 4,138,204 | 2/1979 | Bruguera | 417/300 |
| 4,171,188 | 10/1979 | Anderson | 417/282 |
| 4,237,926 | 12/1980 | Walker | 417/295 |
| 4,345,881 | 8/1982 | Petersson | 417/295 |
| 4,470,427 | 9/1984 | Maillochaud . | |
| 4,512,722 | 4/1985 | Mouton . | |
| 4,531,359 | 4/1985 | Hitzelberger et al. . | |

FOREIGN PATENT DOCUMENTS

| | | | |
|---|---|---|---|
| 2815362 | 10/1979 | Fed. Rep. of Germany | 417/295 |

*Primary Examiner*—William L. Freeh

*Attorney, Agent, or Firm*—MacMillan, Sobanski & Todd

[57] ABSTRACT

A dry valve for a gear pump includes a piston having a valve head and a piston head mounted on the opposite ends of a piston rod. The piston is selectively movable between an opened position, wherein hydraulic fluid is permitted to flow from a reservoir to a pumping chamber of the gear pump, and a closed position, wherein such flow is obstructed. A source of pressurized air exerts a biasing force against the piston head to selectively move the piston. An outlet port of the gear pump is connected through a feedback passageway to the dry valve. The feedback passageway communicates with the side of a chamber in which the piston rod of the dry valve reciprocates between the opened and closed positions. When the dry valve is in the opened position, the pressurized fluid from the outlet port of the gear pump exerts a side-loading pressure against the piston rod, causing a frictional force to be generated between the piston rod and the piston rod chamber which resists relative movement.

10 Claims, 4 Drawing Sheets

GEAR PUMP HAVING CONDITIONAL DRY VALVE CLOSURE STRUCTURE

BACKGROUND OF THE INVENTION

The present invention relates in general to pumping mechanisms for supplying pressurized fluid to hydraulically actuated systems. In particular, the present invention relates to a gear pump having an inlet port shut-off valve, referred to as a dry valve, which is prevented from closing when the fluid pressure delivered from the outlet port of the gear pump to such a hydraulic system is greater than a predetermined maximum safe magnitude. The present invention also relates to an improved means for providing a flow of lubricating and cooling fluid through the gear pump when the dry valve is closed and, thus, the gear pump is operated in the dry mode.

Gear pumps are well known in the art and typically include a pair of gears mounted upon respective shafts for rotation within a pump housing. The shafts are arranged such that the gears mesh within a pumping chamber disposed between an inlet port and an outlet port. One of the shafts is rotated by an external source of power so as to cause the two gears to rotate. In this manner, hydraulic fluid is drawn from a reservoir through the inlet port and is discharged at a relatively high pressure from the outlet port to the hydraulic system.

One common use for gear pumps of this type is on a refuse packing vehicle. Such a vehicle is typically driven by an internal combustion engine and includes one or more movable packing mechanisms which are hydraulically actuated. A gear pump can be connected to and driven by the internal combustion engine to generate a flow of pressurized fluid to operate the packing mechanisms. Because of its size and reliability, the gear pump is well suited to perform this function. Typically, however, such packing mechanisms are used only intermittently, requiring no flow of pressurized fluid for long periods of time. The internal combustion engine, on the other hand, is usually continuously operated. Thus, for this and other uses, some means must be provided for selectively interrupting the flow of pressurized fluid from the gear pump to the hydraulic system.

Several structures are known in the art for accomplishing this selective interruption. A first known structure includes a valve provided between the outlet port of a continuously driven gear pump and the packing mechanisms actuated thereby. The valve is selectively actuated to direct the flow of pressurized fluid from the outlet port of the gear pump either to the packing mechanisms or back to the reservoir. Thus, when the packing mechanisms are not to be utilized, the flow of pressurized fluid is diverted from the packing mechanisms and is returned to the reservoir. Unfortunately, this structure results in undesirable power losses, particularly at high engine speeds and, therefore, at high flow rates.

A second known structure includes a power take-off unit or a clutch provided as a connection between the internal combustion engine and the gear pump. The power take-off unit or clutch selectively makes and breaks the driving connection between the internal combustion engine and the gear pump. When the packing mechanisms are not to be utilized, the power take-off or clutch is disengaged so as to disable the gear pump. As a result, the flow of pressurized fluid to the packing mechanisms is interrupted. These structures, however, increase the cost and complexity of the overall refuse packing system, as well as introduce additional components which are subject to failure.

A third and more preferable structure for interrupting the flow of pressurized fluid from the gear pump to the packing mechanisms includes a dry valve. The dry valve is well known in the art and can simply be described as a shut-off valve disposed in the inlet port of the gear pump. When closed, the dry valve obstructs the flow of hydraulic fluid from the inlet port to the pumping chamber of the gear pump. Consequently, the flow of pressurized fluid to the packing mechanisms is interrupted, even though the gear pump is continued to be operated. When the gear pump is operated while the dry valve is closed, it is said to be operating in the dry mode. Typically, means are provided in the dry valve for permitting a relatively small amount of hydraulic fluid to flow into the pumping chamber even when the dry valve is closed. Such relatively small amount of fluid flow is necessary for lubricating and cooling the components of the gear pump while it is operated in the dry mode.

Several problems associated with the use of a dry valve in a gear pump are related to such flow of lubricating and cooling fluid. In such prior art gear pumps, a bleed valve must be provided between the gear pump and the packing mechanisms to prevent the flow of lubricating and cooling fluid from inadvertently operating the packing mechanisms. The bleed valve causes the relatively small amount of lubricating and cooling fluid to be returned back to the reservoir after being circulated through the gear pump. The use of such a bleed valve results in the undesirable loss of a portion of the pressurized fluid when the dry valve is opened. Thus, it would be desirable to provide a gear pump which avoids this problem.

A third problem associated with the use of a dry valve in a gear pump can occur if the dry valve is attempted to be closed while the pump is generating a flow of hydraulic fluid at a relatively high pressure. Closure of the dry valve during such relatively high pressure output can cause a highly unbalanced pressure condition to occur within the gear pump. Specifically, the pressure within the pumping chamber drops rapidly to a relatively low level when the dry valve is closed. However, the pressure at the outlet port remains relatively high for a short period of time following such closure. In most gear pumps, such outlet port pressure is fed back within the gear pump to urge a pair of opposed pressure plates into sealing engagement with the sides of the gears. During this period of high pressure unbalance, the pressure plates exert excessively large forces against the sides of the gears, resulting in premature wear and failure of the gear pump. Thus, it would be desirable to provide a means for preventing the closure of the dry valve while the gear pump is generating a flow of hydraulic fluid at a pressure which is greater than a predetermined maximum safe magnitude.

SUMMARY OF THE INVENTION

The present invention relates to an improved design for a gear pump having a dry valve. The dry valve includes a piston having a valve head and a piston head mounted on the opposite ends of a piston rod. The piston is selectively movable between an opened position, wherein the valve head is positioned to permit hydraulic fluid to flow from a reservoir to a pumping chamber of the gear pump, and a closed position, wherein the valve head is positioned to obstruct such flow. The piston is actuated for such movement by a source of pressurized air acting on the piston head. The source of pressurized air exerts a biasing force against the piston head to selectively move the piston in either direction. The outlet port of the gear pump is connected to a hydraulic system adapted to be driven by the flow of pressurized fluid. The outlet port is also connected through a feedback passageway formed in the gear pump back to the dry valve. The feedback passageway communicates with the side of a chamber in which the piston rod of the dry valve reciprocates between the opened and closed positions. When the dry valve is in the opened position, the pressurized fluid from the outlet port of the gear pump exerts a side-loading pressure against the piston rod of the dry valve. This side-loading pressure causes a frictional force to be generated between the piston rod and the piston rod chamber which resists relative movement. If the frictional force is greater than the biasing force, the source of pressurized air is unable to move the piston to the closed position. If the frictional force is less than the biasing force, the source of pressurized air is able to move the piston rod to the closed position. Thus, the dry valve may be moved from the opened position to the closed position only if the pressure of the fluid at the outlet port of the gear pump is less than a predetermined maximum safe magnitude. After the dry valve is moved to the closed position, a reduced diameter portion of the piston rod is disposed adjacent the feedback passageway. As a result, fluid is permitted to flow through the feedback passageway and the piston rod chamber to an external drain connected to the reservoir. This structure returns the lubricating and cooling fluid to the reservoir after circulating once through the gear pump.

It is an object of the present invention to provide an improved gear-pump having a dry valve for operating an intermittently actuated hydraulic system.

It is another object of the present invention to provide such a gear pump which prevents the dry valve from being moved from an opened position to a closed position while the gear pump is generating a flow of fluid at a pressure which is greater than a predetermined maximum safe magnitude.

It is a further object of the present invention to provide such a gear pump which permits a relatively small flow of lubricating and cooling fluid while the dry valve is closed and returns such fluid to the reservoir after circulating once through the gear pump, thus preventing damage to the pump when run for long periods in the dry mode.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
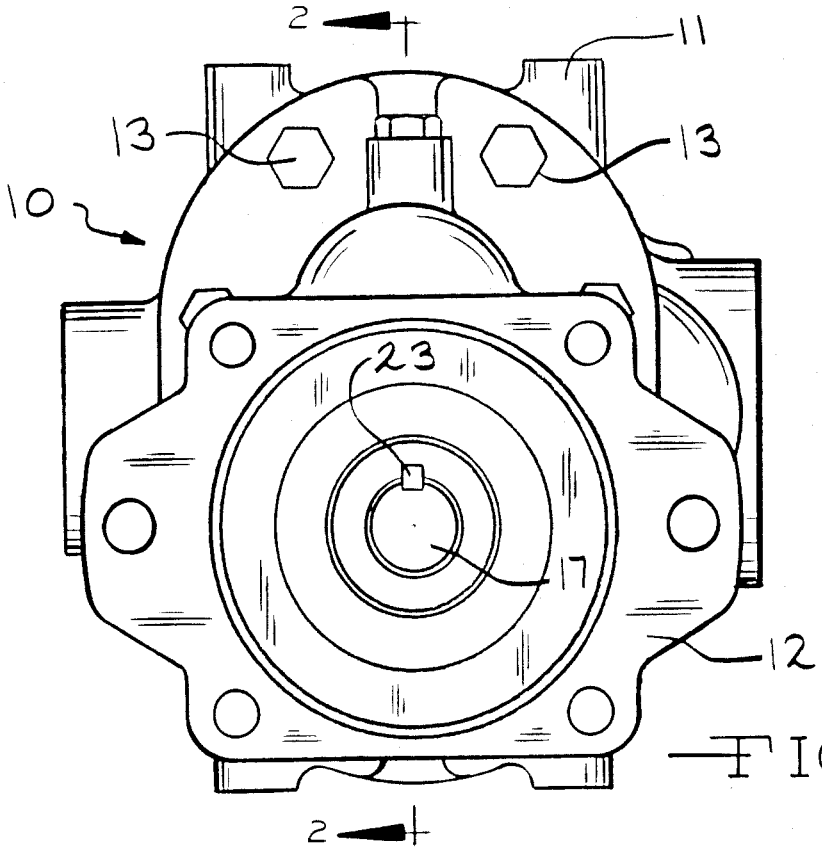
FIG. 1 is an end elevational view of a gear pump in accordance with the present invention.
Figure 2:
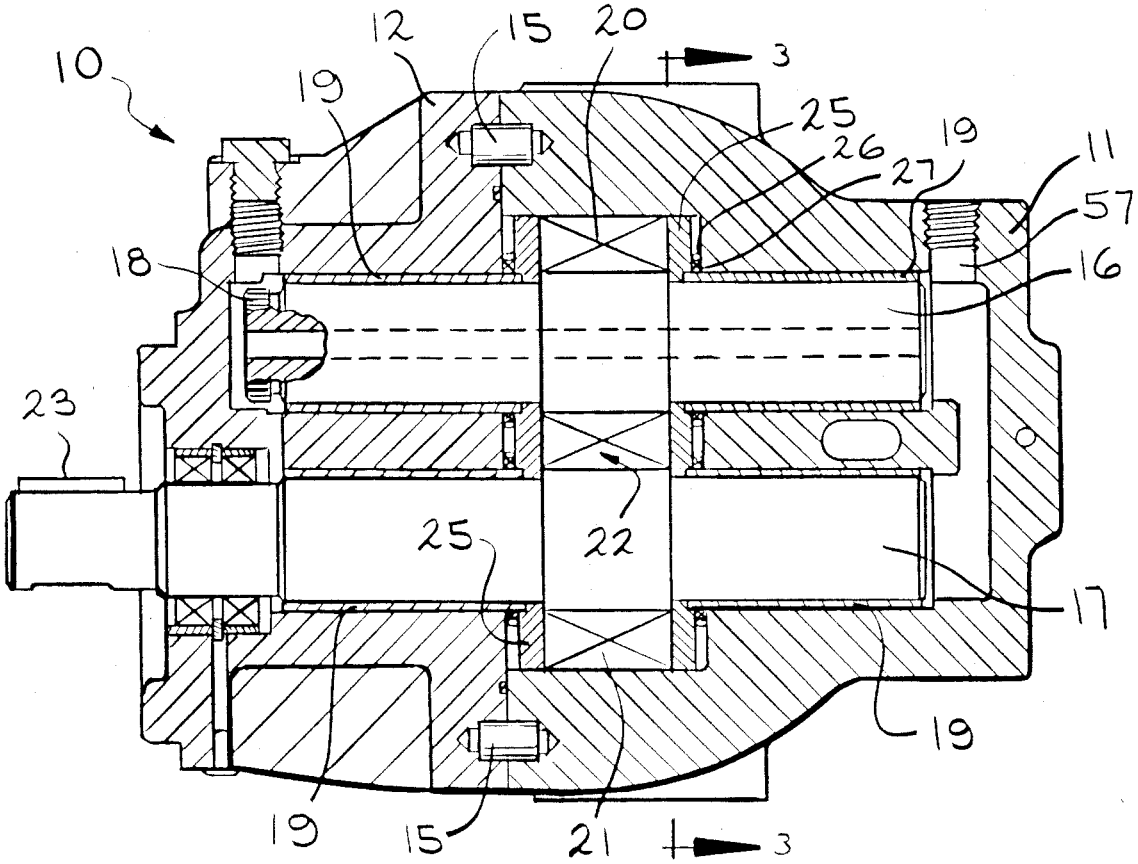
FIG. 2 is a sectional elevational view taken along line 2—2 of FIG. 1.

Referring now to the drawings, there is illustrated a gear pump, indicated generally at 10, in accordance with the present invention. As best shown in FIG. 2, the gear pump 10 includes a pump housing 11 having an end plate 12 secured thereto by a plurality of bolts 13. A plurality of dowels 15 may be provided to support and align the end plate 12 relative to the pump housing 11. Within the gear pump 10, a pair of shafts 16 and 17 are journalled for rotation. The shafts 16 and 17 are disposed in parallel fashion adjacent one another. The ends of each of the shafts 16 and 17 are supported for rotation within the gear pump 10 by respective sleeve bearings 19. The first shaft 16 can be formed having a toothed end portion 18. The toothed end portion 18 can be utilized in conjunction with a conventional sensor (not shown) to generate an electrical signal which is indicative of the rotational speed of the shaft 16.

A first gear, illustrated schematically at 20, is mounted on the first shaft 16 for rotation therewith. Similarly, a second gear, illustrated schematically at 21, is mounted on the second shaft 17 for rotation therewith. The first and second gears 20 and 21 mesh together within a pumping chamber, indicated generally at 22, formed in the gear pump 10. One end of the second shaft 17 extends through the end plate 12 outwardly of the gear pump 10. A key 23 is provided on that end of the second shaft 17. The key 23 permits the second shaft 17 to be connected to a source of power, such as a vehicle engine (not shown), for rotation. A pair of pressure plates 25 are disposed on opposite sides of the first and second gears 20 and 21. The pressure plates 25 are adapted to form a seal between the first and second gears 20 and 21 and the other components of the gear pump 10. An 0-ring 26 and a back-up ring 27 are provided adjacent each of the pressure plates 25, also for sealing purposes.

Figure 3:
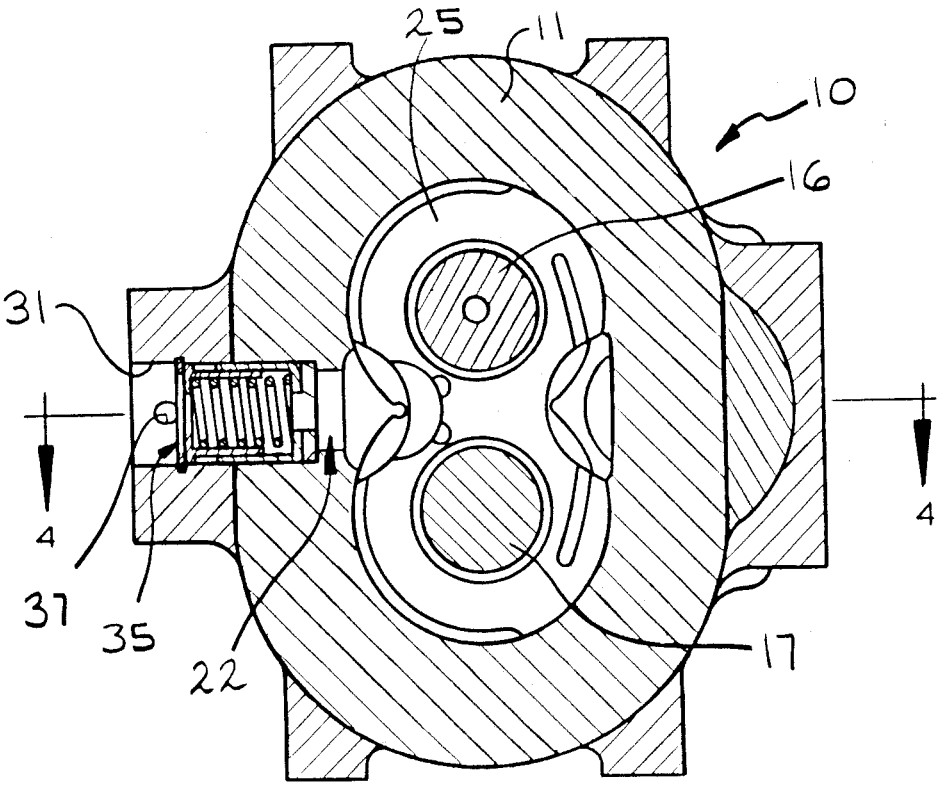
FIG. 3 is a sectional elevational view taken along line 3—3 of FIG. 2.
Figure 4:
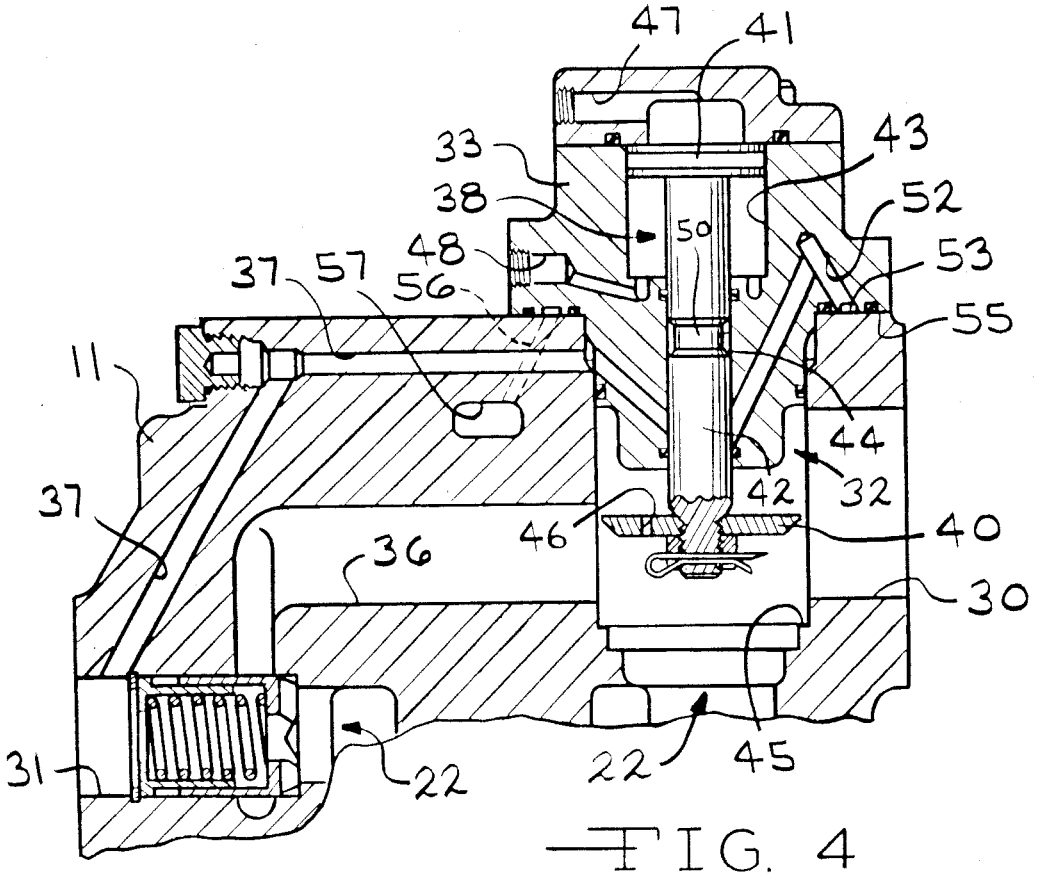
FIG. 4 is a sectional elevational view, partially broken away, taken along line 4—4 of FIG. 3, illustrating the dry valve in the opened position.
Figure 5:
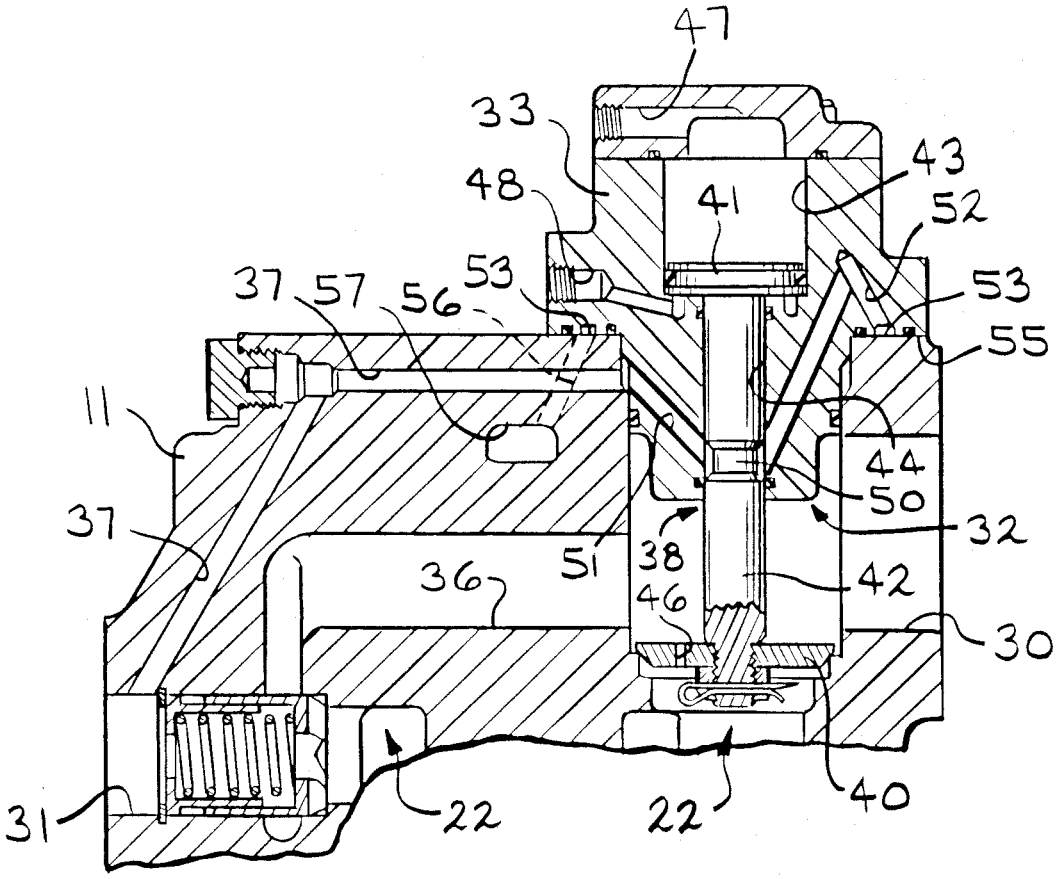
FIG. 5 is a sectional elevational view similar to FIG. 4 illustrating the dry valve in the closed position.

As best shown in FIGS. 4 and 5, the gear pump 10 is provided with an inlet port 30 and an outlet port 31. The inlet port 30 communicates with a reservoir (see FIG. 6) containing a supply of hydraulic fluid at a relatively low pressure. The outlet port 31 communicates with a hydraulic system (see FIG. 6) adapted to be actuated by the flow of pressurized fluid from the gear pump 10. When operated, the gear pump 10 draws hydraulic fluid from the reservoir through the inlet port 30 and discharges such fluid at a relatively high pressure from the outlet port 31 to the hydraulic system. As is well known in the art, the pumping operation of the gear pump 10 is achieved by rotating the second shaft 17 and the second gear 21 in one direction (clockwise when viewing FIG. 3), thereby causing rotation of the first shaft 16 and the first gear 20 in the opposite direction (counterclockwise when viewing FIG. 3). The structure of the gear pump 10 described thus far is conventional in the art.

A dry valve, indicated generally at 32, is provided between the inlet port 30 and the pumping chamber 22. The dry valve 32 is mounted in a valve block 33 secured to the pump housing 11. The structure and operation of the dry valve 32 will be explained in detail below. Briefly, however, the dry valve 32 provides a means for selectively obstructing the flow of hydraulic fluid from the inlet port 30 to the pumping chamber 22. When the dry valve 32 is opened, such flow is not obstructed, and the gear pump 10 is enabled to generate a flow of pressurized fluid through the outlet port to the hydraulic system as described above. This is referred to as the active mode of operation of the gear pump 10. When the dry valve 32 is closed, however, the gear pump 10 is prevented from providing the flow of pressurized fluid, even though the first and second shafts 16 and 17 and the first and second gears 20 and 21 mounted respectively thereon continue to be rotated. This is referred to as the dry mode of operation of the gear pump 10.

A priority flow control valve, indicated generally at 35, is provided between the pumping chamber 22 and the outlet port 31. The priority flow control valve 35 is conventional in the art and forms no part of the present invention. The priority flow control valve 35 regulates the amount of pressurized fluid flowing through the outlet port 31 to the hydraulic system by diverting excess flow greater than the regulated flow into an excess flow passageway 36 formed in the gear pump 10. Thus, the priority flow control valve limits the amount of pressurized fluid flowing through the outlet port 31 to a predetermined regulated level. The excess flow passageway 36 communicates with the inlet port 30. Consequently, the excess flow of pressurized fluid is returned directly from the pumping chamber 22 to the inlet port 30. A feedback passageway 37 is also formed in the gear pump 10. The feedback passageway 37 extends between the outlet port 31 and the valve block 33. Pressurized fluid which is delivered from the outlet port 31 to the hydraulic system is, therefore, also provided through the feedback passageway 37 to the valve block 33. The function of the feedback passageway 37 will be described in detail below.

Referring to FIGS. 4 and 5, the structures of the dry valve 32 and the valve block 33 are illustrated in detail. The dry valve 32 includes a piston, indicated generally at 38, having a valve head 40 and a piston head 41 connected to the opposite ends of a piston rod 42. The piston head 41 is enclosed within a piston head chamber 43 formed in the valve block 33, while the valve head 40 extends outwardly from the valve block 33 into the inlet port 30. The piston rod 42 is disposed within a piston rod chamber 44 formed in the valve block 33 and is axially moveable therethrough. The piston 38 is adapted to reciprocate between an opened position (illustrated in FIG. 4) and a closed position (illustrated in FIG. 5). In the opened position, the valve head 40 is positioned within the inlet port 30 so as not to obstruct the flow of hydraulic fluid therethrough to the pumping chamber 22. In the closed position, however, the valve head 40 is moved into engagement with a seat 45 formed at the junction between the inlet port 30 and the pumping chamber 22. When so seated, the valve head 40 obstructs the flow of hydraulic fluid into the pumping chamber 22. A small aperture 46 is formed through the valve head 40 which permits a relatively small amount of hydraulic fluid to flow from the inlet port 30 into the pumping chamber 22, even when the piston 38 is in the closed position. This relatively small flow of hydraulic fluid through the aperture 46 is utilized for lubricating and cooling the components of the gear pum 10 when the piston 38 is in the closed position, as will be described in detail below.

As mentioned above, the piston head 41 is disposed within the piston head chamber 43 formed in the valve block 33. First and second passageways 47 and 48 are formed in the valve block 33 which communicate with the piston head chamber 43 on opposite sides of the piston head 41. The first and second passageways 47 and 48 communicate with a control means (see FIG. 6) for selectively supplying pressurized air through one of the passageways 47 and 48 and for simultaneously venting the other of the passageways 47 and 48 to the atmosphere. When pressurized air is supplied through the second passageway 48 while the first passageway 47 is vented, the piston 38 is biased to move toward the opened position illustrated in FIG. 4. When pressurized air is supplied to the first passageway 47 and the second passageway 48 is vented, the piston 38 is biased to move toward the closed position illustrated in FIG. 5. One example of a satisfactory control means is discussed below in connection with FIG. 6. However, it will be appreciated that any similar means for generating a biasing force to move the piston 38 between its opened and closed positions is contemplated to be within the scope of the present invention.

The piston rod 42 has a reduced diameter portion 50 formed therein between the valve head 40 and the piston head 41. As shown in FIGS. 4 and 5, the reduced diameter portion 50 is located on the piston rod 42 such that it is always disposed within the piston rod chamber 44, regardless of whether the piston 38 is in the opened or closed positions. When the piston 38 is in the closed position illustrated in FIG. 5, the reduced diameter portion 50 is disposed adjacent both a third passageway 51 and a fourth passageway 52 formed in the valve block 33. The third passageway 51 provides communication between the feedback passageway 37 and the piston rod chamber 44. The fourth passageway 52 provides communication between the piston rod chamber 44 and an annular groove 53 formed in an end face 55 of the valve block 33. The end face 55 sealingly abuts the outer surface of the pump housing 11 when the valve block 33 is secured thereto. Thus, the groove 53 defines an annular chamber between the valve block 33 and the pump housing 11. The groove chamber 53 communicates with a drain passageway, indicated by dotted lines at 56, formed in the pump housing 11. The drain passageway 56 communicates with a drain port 57, also formed in the pump housing 11. The drain port 57 communicates directly with the reservoir (see FIG. 6) for returning the hydraulic fluid thereto.

Figure 6:
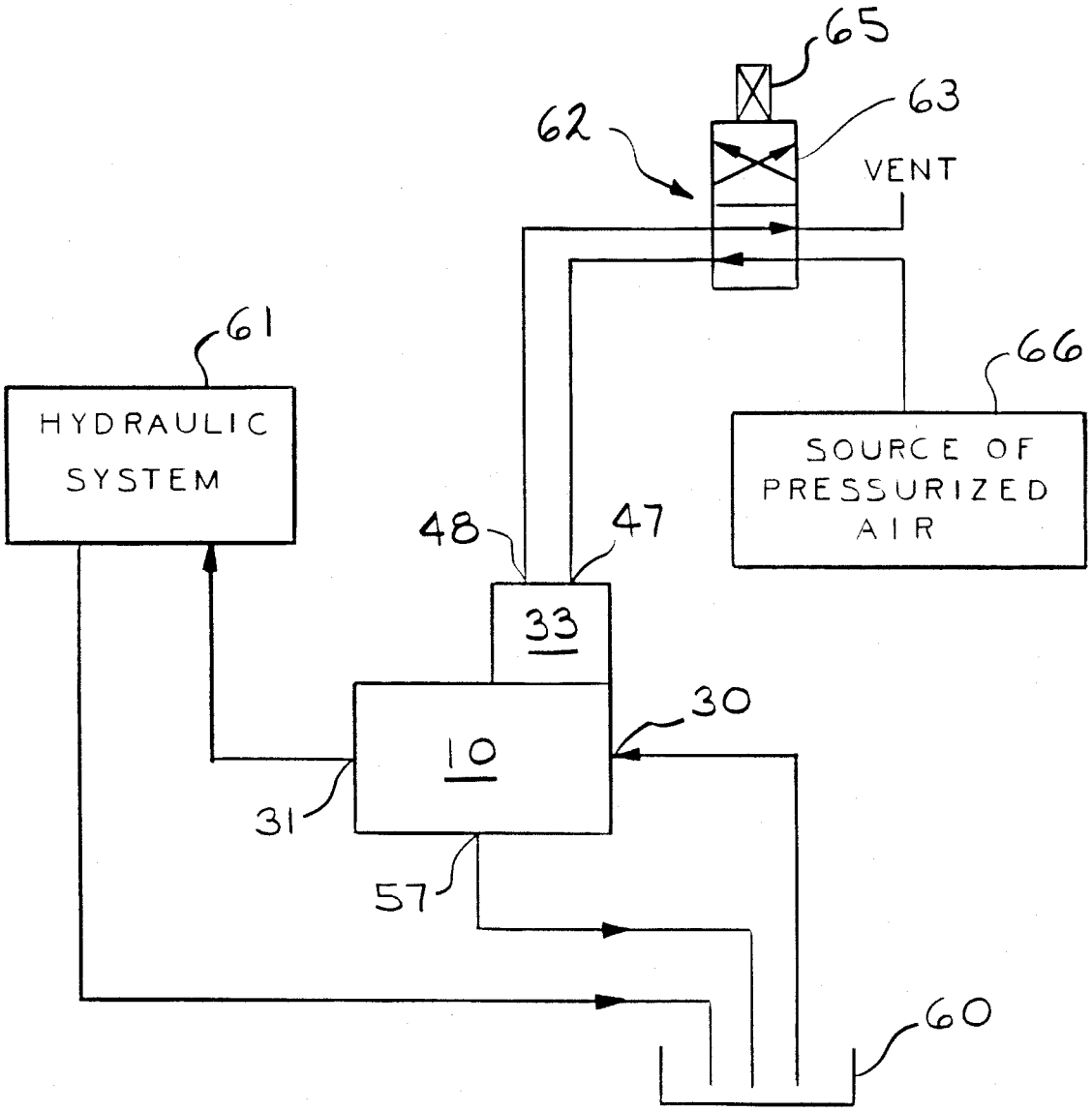
FIG. 6 is a schematic diagram of a hydraulic circuit including the gear pump of FIG. 1.
Figure 4:
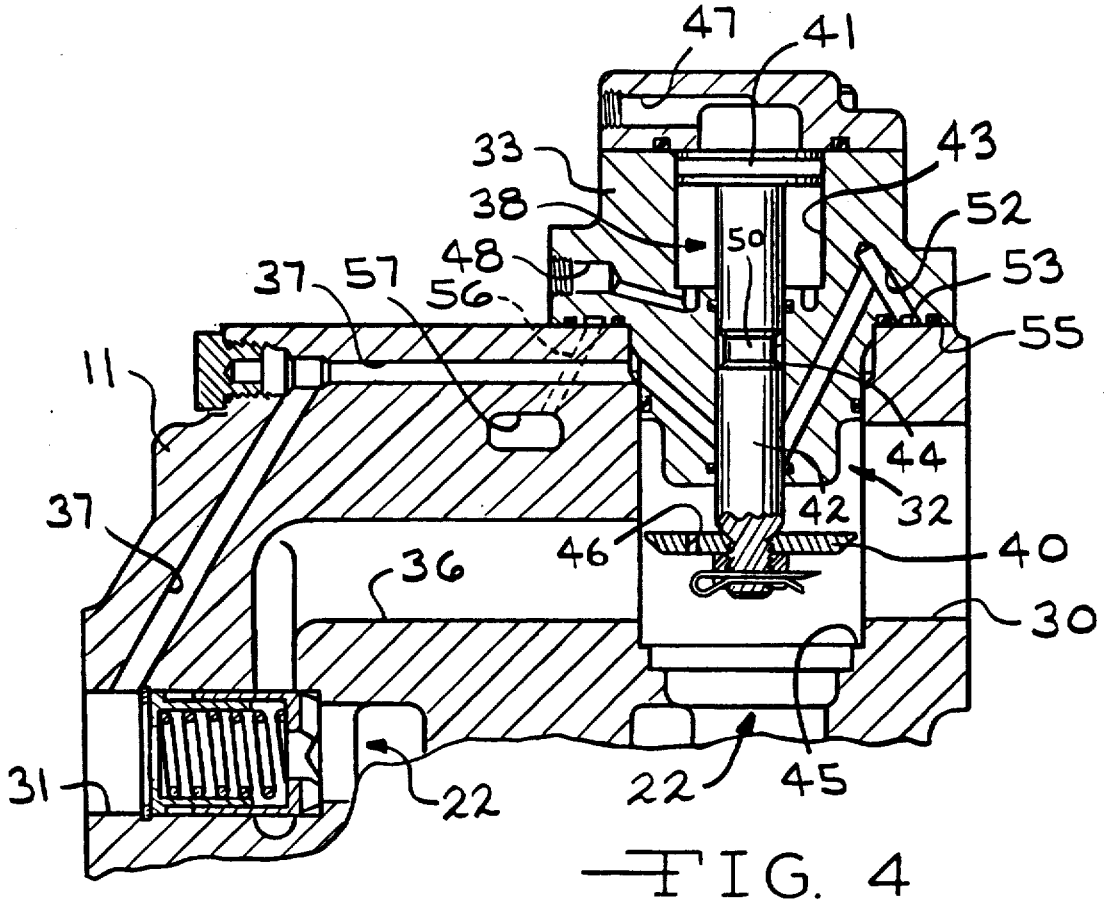

Referring now to FIG. 6, a schematic diagram of a hydraulic circuit including the gear pump 10 of the present invention is illustrated. As shown therein, a reservoir 60 is provided to supply hydraulic fluid to the inlet port 30 of the gear pump 10. The outlet port 31 of the gear pump 10 communicates with a hydraulic system 61. The reservoir 60 also receives hydraulic fluid from the drain port 57 of the gear pump 10 and from the hydraulic system 61. A control means, indicated generally at 62, is provided to selectively generate a biasing force to move the piston 38 of the dry valve 32 between its opened and closed positions, as described above. In the illustrated embodiment, the control means 62 includes a two-position valve 63 which is actuated by means of a solenoid driver 65. The valve 63 is connected between the first and second passageways 47 and 48, respectively, formed in the valve block 33 and a source of pressurized air 66.

When the valve 63 is in the first position illustrated in FIG. 6, the source of pressurized air 66 communicates through the first passageway 47 with the upper side (when viewing FIGS. 4 and 5) of the piston head chamber 43 formed in the valve block 33. Consequently, a pressure is exerted against the upper side of the piston head 41. At the same time, the lower side of the piston head chamber 43 is vented through the second passageway 48 and the valve 63 to the atmosphere. The resulting pressure differential causes a downwardly directed force to be generated against the piston head 41. Under normal circumstances, the piston 38 will be moved to (or remain in) the closed position illustrated in FIG. 5 in response to this downwardly directed biasing force. The solenoid 65 may be activated to move the valve 63 to a second position, wherein the first passageway 47 is vented to the atmosphere and the second passageway 48 communicates with the source of pressurized air. The pressure differential across the piston head 41 is reversed, causing an upwardly directed force to be generated against the piston head 41. Under normal circumstances, the piston 38 will be moved to (or remain in) the opened position illustrated in FIG. 4 in response to this upwardly directed biasing force.

To operate the gear pump 10, the second shaft 17 is connected to rotate continuously with the vehicle engine. As a result, the first and second gears 20 and 21 are also continuously rotated. Assuming that the dry valve 32 initially is in the closed position illustrated in FIG. 5, the gear pump 10 will be operated in the dry mode. In such mode, the hydraulic fluid in the reservoir 60 is prevented from entering the pumping chamber 22 by the valve head 40. However, the aperture 46 permits a relatively small amount of hydraulic fluid to flow through the valve head 40 into the pumping chamber 22. This small amount of hydraulic fluid lubricates and cools the gears 20 and 21 and related components of the gear pump 10 while it is operated in the dry mode. The priority flow control valve 35 permits the small amount of hydraulic fluid to flow therethrough into the outlet port 31. At that point, however, all of such fluid will be diverted into the feedback passageway 37. This occurs because the reduced diameter portion 50 of the piston rod 42 is positioned to provide a path from the feedback passageway 37 through the third passageway 51, the piston rod chamber 44, the fourth passageway 52, the groove chamber 53, the drain passageway 56, and the drain port 57 to the reservoir 60. The fluid flows through this path because it faces a path of higher resistance from the outlet port 31 to the hydraulic system 61. Thus, while the gear pump 10 is in the dry mode, no fluid is delivered to operate the hydraulic system 61.

When it is desired to operate the hydraulic system 61, the solenoid 65 is activated to move the valve 63 from the first position illustrated in FIG. 6 to the second position. As a result, a pressure differential is created across the piston head 41 urging it upwardly (when viewing FIGS. 4 and 5) as described above. In response thereto, the piston 38 is moved to the opened position illustrated in FIG. 4. When so moved, the valve head 40 is moved out of engagement with the seat 45 to permit hydraulic fluid to flow from the inlet port 30 into the pumping chamber 22. Pressurized fluid flows through the priority flow control valve 35 and the outlet port 31 to the hydraulic system 61. The pressurized fluid does not flow through the above-described path to the reservoir 60 because the reduced diameter portion 50 of the piston rod 42 is moved away from the third passageway 51 and the fourth passageway 52 when the piston 38 is moved to the opened position. As a result, communication between the third passageway 51 and the fourth passageway 52 is prevented. However, the pressurized fluid from the outlet port 31 does exert a pressure against the side of the piston rod 42 which is disposed adjacent the third passageway 51. This side-loading pressure is utilized when it is desired to move the piston 38 back to the closed position, as described below. However, so long as the piston 38 is in the opened position, pressurized fluid is supplied from the gear pump 10 to operate the hydraulic system 61.

When it is desired to disable the hydraulic system 61 from operation, the solenoid 65 is activated to move the valve 63 back to the first position illustrated in FIG. 6. As a result, a pressure differential is again created across the piston head 41 urging it downwardly (when viewing FIGS. 4 and 5) toward the closed position. This pressure differential can be translated into a biasing force which is directed axially downwardly relative to the piston 38. The magnitude of this biasing force is determined basically by the magnitude of the pressure differential and the area of the piston head 41 exposed to such pressure differential.

At the same time, however, the piston 38 is subjected to a side-loading pressure because of the relatively high pressure fluid being provided from the outlet port 31 through the feedback passageway 37. The side-loading pressure can be translated into a frictional force generated between the piston rod 42 and the piston rod chamber 44. This frictional force resists axial movement of the piston rod 42 relative to the piston rod chamber 44. The magnitude of the frictional force is determined basically by the magnitude of the pressure of the hydraulic fluid from the outlet port 31, the area of the piston rod 42 exposed to such pressure, and the coefficient of friction between the piston rod 42 and the piston rod chamber 44. When the magnitude of the biasing force is greater than the magnitude of the frictional force, the piston 38 will be moved from the opened position to the closed position. When the magnitude of the biasing force is less than the magnitude of the frictional force, the piston 38 will not be moved to the closed position.

As previously mentioned, it is undesirable to close the dry valve 32 when the gear pump 10 is generating a flow of fluid through the outlet port 31 at a pressure which is greater than a predetermine maximum safe magnitude. By appropriately selecting the size of the opening of the third passageway 51 which opens into the piston rod chamber 44 or the maximum pressure the source of pressurized air is capable of exerting, the dry valve 32 can be held automatically in its opened position until the pressure of the fluid flowing from the outlet port 31 drops below the predetermined maximum safe magnitude. As soon as the pressure of the fluid flowing from the outlet port 31 does drop below the predetermined maximum safe magnitude, the dry valve 32 will be moved to the closed position. The closure of the dry valve 32 is automatically prevented until the fluid pressure at the outlet port 31 is less than the predetermined maximum safe magnitude.

In accordance with the provisions of the patent statutes, the principle and mode of operation of the present invention have been explained and illustrated in its preferred embodiment. It must be understood, however, that the present invention may be practiced otherwise than as specifically explained and illustrated without departing from its spirit or scope.

What is claimed is:

1. A pump for selectively generating a flow of pressurized fluid to a hydraulic system from a reservoir comprising:

an inlet port communicating with the reservoir;

an outlet port communicating with the hydraulic system;

a pumping chamber formed within the pump communicating with said inlet port and said outlet port;

pumping means disposed in said pumping chamber and adapted to draw fluid through said inlet port from the reservoir and to generate a flow of pressurized fluid through said outlet port to the hydraulic system;

dry valve means selectively movable between an opened position, wherein the flow of fluid from said inlet port to said pumping chamber is unobstructed, and a closed position, whereby the flow of fluid from said inlet port to said pumping chamber is obstructed; and means responsive to the pressure of the fluid in said outlet port for preventing said dry valve means from being moved from said opened position to said closed position when the outlet port fluid pressure exceeds a predetermined magnitude.

2. The invention defined in claim 1 wherein said dry valve means includes a member which is movable between said opened and closed positions, and said means for preventing includes means for applying the outlet port fluid pressure against said moveable member to prevent said movement.

3. The invention defined in claim 1 wherein said dry valve means includes a piston rod which is axially movable through a piston rod chamber formed in said dry valve means, and said means for preventing includes passageway means providing communication between said outlet port and said piston rod chamber for applying the outlet port fluid pressure against said piston rod to prevent said movement.

4. The invention defined in claim 3 wherein said dry valve means further includes a piston head secured to said piston rod and means for generating a biasing force against said piston head urging movement thereof from said opened position to said closed position.

5. The invention defined in claim 4 wherein said outlet port fluid pressure applied against said piston rod generates a frictional force which resists movement of said piston rod, whereby said piston rod will be moved from said opened position to said closed position only when said biasing force is greater than said frictional force.

6. A gear pump for selectively generating a flow of pressurized fluid to a hydraulic system from a reservoir comprising:

an inlet port communicating with the reservoir;

an outlet port communicating with the hydraulic system;

a pumping chamber formed within the pump communicating with said inlet port and said outlet port;

pumping means disposed in said pumping chamber and adapted to draw fluid through said inlet port from the reservoir and to generate a flow of pressurized fluid through said outlet port to the hydraulic system, said pumping means including a pair of rotatably driven meshing gears;

dry valve means selectively movable between an opened position, wherein the flow of fluid from said inlet port to said pumping chamber is unobstructed, and a closed position, whereby the flow of fluid from said inlet port to said pumping chamber is obstructed; and means for permitting a relatively small amount of fluid to flow from said inlet port to said pumping chamber when said dry valve means is in the closed position, said dry valve means including means for providing a path for said relatively small amount of fluid to flow from said outlet port to the reservoir when said dry valve means is in the closed position.

7. The invention defined in claim 6 wherein said dry valve means includes a piston rod which is axially movable through a piston rod chamber formed in said dry valve means, and said means for providing a path includes first passageway means providing communication between said outlet port and said piston rod chamber, second passageway means providing communication between said said piston rod chamber and the reservoir, and means formed on said piston rod for selectively permitting communication between said first and second passageway means through said piston rod chamber.

8. The invention defined in claim 7 wherein said means for selectively permitting communication includes a reduced diameter portion formed on said piston rod.

9. The invention defined in claim 8 wherein said reduced diameter portion of said piston rod is disposed adjacent said first and second passageway means only when said dry valve mean is in said closed position.

10. A pump for selectively generating a flow of pressurized fluid to a hydraulic system from a reservoir comprising:

an inlet port communicating with the reservoir;

an outlet port communicating with the hydraulic system;

a pumping chamber formed within the pump communicating with said inlet port and said outlet port;

pumping means disposed in said pumping chamber and adapted to draw fluid through said inlet port from the reservoir and to generate a flow of pressurized fluid through said outlet port to the hydraulic system;

dry valve means selectively movable between an opened position, wherein the flow of fluid from said inlet port to said pumping chamber is unobstructed, and a closed position, whereby the flow of fluid from said inlet port to said pumping chamber is obstructed;

means responsive to the pressure of the fluid in said outlet port for preventing said dry valve means from being moved from said opened position to said closed position when the outlet port fluid pressure exceeds a predetermined magnitude; and means for permitting a relatively small amount of fluid to flow from said inlet port to said pumping chamber when said dry valve means is in the closed position, said dry valve means including means for providing a path for said relatively small amount of fluid to flow from said outlet port to the reservoir when said dry valve means is in the closed position.

* * * * *

REEXAMINATION CERTIFICATE (1583rd)

United States Patent [19] [11] B1 4,746,276

McBurnett et al. [45] Certificate Issued Oct. 29, 1991

[54] GEAR PUMP HAVING CONDITIONAL DRY VALVE CLOSURE STRUCTURE

[75] Inventors: James R. McBurnett; James M. Eley; Kuldip Raina, all of Corinth, Miss.

[73] Assignee: Dana Corporation

Reexamination Request:
No. 90/002,227, Dec. 12, 1990

Reexamination Certificate for:

| | |
|---|---|
| Patent No.: | **4,746,276** |
| Issued: | **May 24, 1988** |
| Appl. No.: | **20,007** |
| Filed: | **Feb. 27, 1987** |

[51] Int. Cl.[5] ..... F04B 49/02; F04B 49/08

[52] U.S. Cl. ..... 417/295; 417/310

[56] References Cited

U.S. PATENT DOCUMENTS

| | | | |
|---|---|---|---|
| 3,280,557 | 4/1965 | Sattavara . | |
| 3,407,894 | 9/1967 | Thompson et al. . | |
| 3,424,262 | 7/1967 | Kunz . | |
| 3,434,282 | 4/1967 | Shelhart . | |
| 3,447,496 | 6/1969 | Short | 417/295 |
| 3,476,055 | 11/1969 | Crowther | 417/440 |
| 3,696,613 | 10/1972 | Goodale . | |
| 3,747,725 | 7/1973 | Feustel et al. . | |
| 3,935,917 | 2/1976 | Eley | 60/459 |
| 4,138,204 | 2/1979 | Bruguera | 417/300 |
| 4,171,188 | 10/1979 | Anderson | 417/282 |
| 4,237,926 | 12/1980 | Walker | 417/295 |
| 4,345,881 | 8/1982 | Petersson | 417/295 |
| 4,470,427 | 9/1984 | Maillochauud . | |
| 4,512,722 | 4/1985 | Mouton . | |
| 4,531,359 | 4/1985 | Hitzelberger et al. . | |

OTHER PUBLICATIONS

"Dry Valve for CSI Pumps", 1985 Commercial Shearing, Inc. News Release, Commercial Shearing, Inc., May 6, 1985 Spool Valve Drawing.

*Primary Examiner*—Leonard E. Smith

[57] ABSTRACT

A dry valve for a gear pump includes a piston having a valve head and a piston head mounted on the opposite ends of a piston rod. The piston is selectively movable between an opened position, wherein hydraulic fluid is permitted to flow from a reservoir to a pumping chamber of the gear pump, and a closed position, wherein such flow is obstructed. A source of pressurized air exerts a biasing force against the piston head to selectively move the piston. An outlet port of the gear pump is connected through a feedback passageway to the dry valve. The feedback passageway communicates with the side of a chamber in which the piston rod of the dry valve reciprocates between the opened and closed positions. When the dry valve is in the opened position, the pressurized fluid from the outlet port of the gear pump exerts a side-loading pressure against the piston rod, causing a frictional force to be generated between the piston rod and the piston rod chamber which resists relative movement.

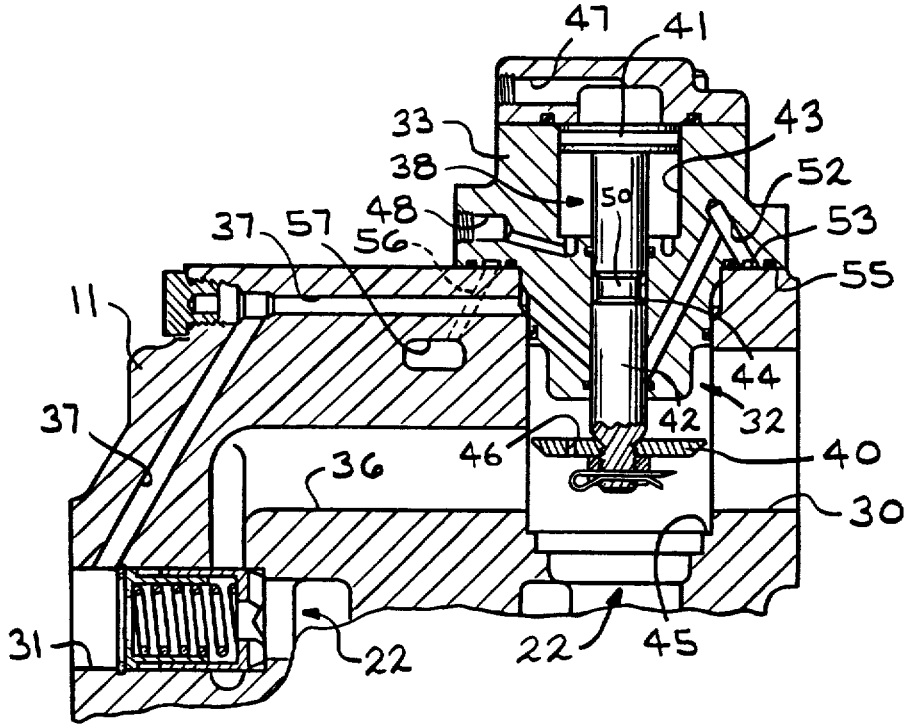

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-5 and 10 is confirmed.

Claim 6 is cancelled.

Claim 7 is determined to be patentable as amended.

Claims 8 and 9, dependent on an amended claim, are determined to be patentable.

7. The invention defined in claim [6] *10* wherein said dry valve means includes a piston rod which is axially movable through a piston rod chamber formed in said dry valve means, and said means for providing a path includes first passageway means providing communication between said outlet port and said piston rod chamber, second passageway means providing communication between [said] said piston rod chamber and the reservoir, and means formed on said piston rod for selectively permitting communication between said first and second passageway means through said piston rod chamber.

* * * * *